US009429884B2

(12) United States Patent
Kanno

(10) Patent No.: US 9,429,884 B2
(45) Date of Patent: Aug. 30, 2016

(54) IMAGE FORMING APPARATUS

(71) Applicant: CANON KABUSHIKI KAISHA, Tokyo (JP)

(72) Inventor: Naoki Kanno, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/947,671

(22) Filed: Nov. 20, 2015

(65) Prior Publication Data

US 2016/0147183 A1 May 26, 2016

(30) Foreign Application Priority Data

Nov. 25, 2014 (JP) ..... 2014-238169

(51) Int. Cl.
*G03G 15/16* (2006.01)

(52) U.S. Cl.
CPC ..... *G03G 15/1665* (2013.01); *G03G 15/1675* (2013.01)

(58) Field of Classification Search
CPC ..... G03G 15/1665; G03G 16/1675
USPC ..... 399/66
See application file for complete search history.

(56) References Cited

U.S. PATENT DOCUMENTS

| | | | | |
|---|---|---|---|---|
| 6,973,275 | B2 * | 12/2005 | Sasai | G03G 21/0064 399/149 |
| 9,002,227 | B2 | 4/2015 | Ohno et al. | |
| 9,063,473 | B2 * | 6/2015 | Kato | G03G 15/161 |
| 2013/0195519 | A1 | 8/2013 | Ito et al. | |
| 2015/0153703 | A1 | 6/2015 | Ohno et al. | |

FOREIGN PATENT DOCUMENTS

| | | | |
|---|---|---|---|
| JP | 2000-235317 | A | 8/2000 |
| JP | 2011-242512 | A | 12/2011 |
| JP | 2012-137733 | A | 7/2012 |
| JP | 2014-059581 | A | 4/2014 |
| JP | 2014-081494 | A | 5/2014 |

* cited by examiner

*Primary Examiner* — Hoang Ngo
(74) *Attorney, Agent, or Firm* — Fitzpatrick, Cella, Harper & Scinto

(57) ABSTRACT

A control unit changes the polarity of a potential of an intermediate transfer member in a primary transfer portion by changing the polarity of voltage to be applied to a secondary transfer member, and applies first voltage in a first step of forming an image on a recording material by transferring a toner image. A detection device detects the presence/absence of the recording material at a timing when a rear end of the toner image reaches a second position which is upstream of a secondary transfer portion on a conveyance path of the toner image. The control unit determines a timing to switch the voltage to be applied to the secondary transfer member from the first voltage to second voltage having polarity opposite to that of the first voltage, based on the detection result by the detection device.

13 Claims, 13 Drawing Sheets

IMAGE FORMING APPARATUS

BACKGROUND OF THE INVENTION

1. Field of the Invention

The present invention relates to a color image forming apparatus that uses an electrophotographic process or the like.

2. Description of the Related Art

An image forming apparatus having a configuration to use an intermediate transfer member is known as an electrophotographic type image forming apparatus. In this image forming apparatus, as a primary transfer step, a toner image is formed on a photosensitive drum (image bearing member: first image bearing member) of each image forming station, such as yellow (Y), magenta (M), cyan (C) and black (Bk). Then a toner image with a plurality of superimposed colors is formed by sequentially transferring the toner image on each photosensitive drum to the surface of an intermediate transfer belt (intermediate transfer member). Then as a secondary transfer step, the toner image with a plurality of colors formed on the surface of the intermediate transfer belt is transferred in batch to the surface of a recording material, such as paper. The toner image with the plurality of colors transferred in batch to the recording material is permanently fixed to the recording material by a fixing unit, and is formed on the recording material as a color image.

In some cases the image forming apparatus performs various image forming apparatus adjustment processing during continuous image formation or after image formation ends, as a separate step from an image forming step. For example, a turn-up prevention control for a cleaning blade, which is used for cleaning the toner off the image bearing member inside the cartridge, will be described as an image forming apparatus adjustment processing. In an image forming apparatus that includes a cleaning blade, if toner on the cleaning blade nip runs out and the friction force of the blade becomes excessive, faulty cleaning may occur and eventually a blade turn-up may occur. To prevent this faulty cleaning and blade turn-up, toner is periodically supplied to the cleaning blade nip, so as to lubricate the blade (hereafter called "toner ejection processing").

Whether this control is executed or not is normally determined by a number of pages, printing rate or the like of the images to be formed. If the toner ejection processing execution conditions are satisfied during continuous image formation or after image formation ends, the image forming apparatus interrupts the image forming processing if it is during the image formation, and forcibly forms an electrostatic latent image on the photosensitive drum, and this image is visualized as a toner image. In the toner image formed here, a potential of the primary transfer portion has reversed polarity of the polarity used for primary transfer; therefore, this toner image is not transferred to the intermediate transfer belt, but is supplied to the cleaning blade unit.

In the above mentioned image forming apparatus adjustment processing, the primary transfer portion must be controlled independently from the secondary transfer portion, and in the case of a conventional configuration where the primary transfer portion and the secondary transfer portion have a high voltage power supply, respectively, predetermined potential polarity can be outputted by independently controlling voltage and current for the primary transfer portion and the secondary transfer portion, respectively. In other words, regardless of the transfer state of the secondary transfer portion, the primary transfer portion can output a predetermined potential polarity independently, and perform processing. However, Japanese Patent Application Laid-Open No. 2012-137733 proposes a configuration to perform both the primary transfer and the secondary transfer using current supplied from the secondary t ransfer portion to the intermediate transfer belt.

It is difficult, however, to independently control the potential polarity of the primary transfer portion and the secondary transfer portion since the potential polarity of the primary transfer portion is controlled by voltage applied to the secondary transfer member. Depending on the switching timing of the potential polarity, toner of the secondary transfer portion may adhere to a recording material passing through the secondary transfer portion.

SUMMARY OF THE INVENTION

It is an object of the present invention to provide a technique to reduce process time while decreasing influence on the secondary transfer by the switching of current supplied to the secondary transfer portion.

To achieve the above object, the present invention provides an image forming apparatus, comprising:

an image bearing member that bears a toner image;

an intermediate transfer member onto which the toner image is primarily transferred from the image bearing member in a primary transfer portion that contacts the image bearing member;

a secondary transfer member that constitutes, together with the intermediate transfer member, a secondary transfer portion, and secondarily transfers the toner image from the intermediate transfer member to a recording material in the secondary transfer portion; and a control unit that controls voltage to be applied to the secondary transfer member, wherein the control unit changes polarity of a potential of the intermediate transfer member in the primary transfer portion by changing polarity of the voltage to be applied to the secondary transfer member, applies first voltage in a first step of forming an image on the recording material by transferring the toner image, and applies second voltage having polarity opposite to that of the first voltage, in a second step, and in the transition from the first step to the second step, the control unit applies the second voltage to the secondary transfer member after the recording material and the toner image pass through the secondary transfer portion in the first step.

To achieve the above object, the present invention provides an image forming apparatus, comprising:

an image bearing member that bears a toner image;

an intermediate transfer member onto which the toner image is primarily transferred from the image bearing member in a primary transfer portion that contacts the image bearing member;

a secondary transfer member that constitutes, together with the intermediate transfer member, a secondary transfer portion, and secondarily transfers the toner image from the intermediate transfer member to a recording material in the secondary transfer portion;

a detection device that detects the presence/absence of a recording material at a first position which is upstream of the secondary transfer portion on a conveyance path of the recording material; and a control unit, wherein the control unit changes polarity of a potential of the intermediate transfer member in the primary transfer portion by changing polarity of voltage to be applied to the secondary transfer member, and applies first voltage in a first step of forming an image on the recording material by transferring the toner image, the detection device detects the presence/absence of the recording material at a timing when a rear end of the toner image reaches a second position which is upstream of the secondary transfer portion on a conveyance path of the toner image, and based on the detection result by the detection device, the control unit determines a timing when the voltage to be applied to the secondary transfer member is switched from the first voltage to second voltage having polarity opposite to that of the first voltage.

Further features of the present invention will become apparent from the following description of exemplary embodiments with reference to the attached drawings.

DESCRIPTION OF THE EMBODIMENTS

Embodiments of the present invention will be described using examples with reference to the drawings. Dimensions, materials and shapes of the components and relative configurations thereof according to the embodiments should be appropriately changed in accordance with the configuration and various conditions of the apparatus to which the invention is applied. In other words, the following embodiments are not intended to limit the scope of the present invention.

Example 1

Figure 1:
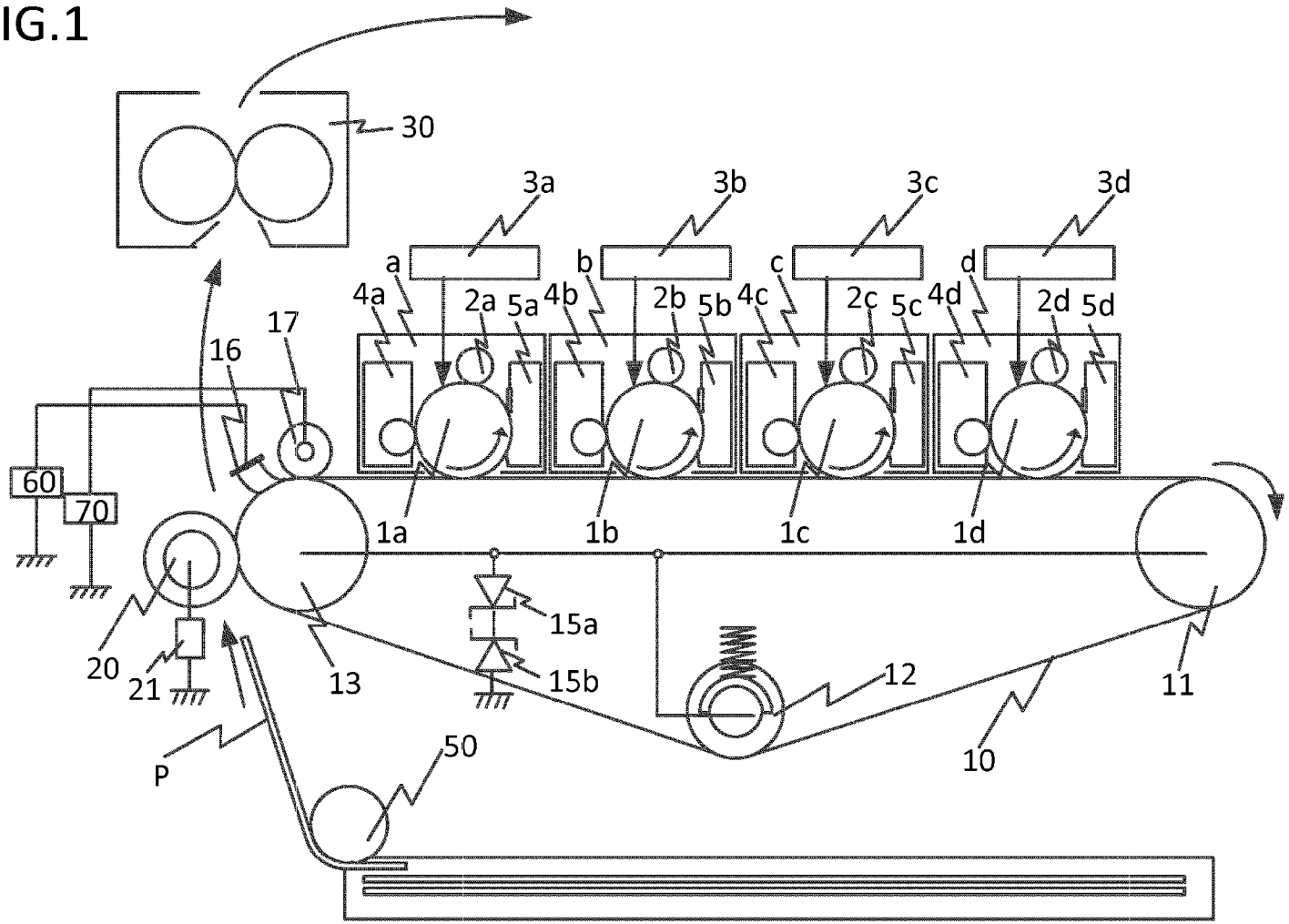
FIG. 1 is a diagram depicting a configuration of an image forming apparatus according to Example 1 of the present invention.

FIG. 1 is a schematic diagram depicting a configuration of an image forming apparatus according to Example 1 of the present invention. The image forming apparatus according to this example has a four-drum type (in-line type) printer that acquires full color print images. The image forming apparatus according to this example is constituted by first to fourth image forming stations, where the first station (a) is for yellow, the second station (b) is for magenta, the third station (c) is for cyan, and the fourth station (d) is for black. A photosensitive drum 1 (1*a*, 1*b*, 1*c*, 1*d*), which is a first image bearing member, is disposed on each station and is rotary-driven in the arrow direction in FIG. 1 respectively, and sequentially transfers a toner image continuously formed by the respective color (multiple transfer) on an intermediate transfer belt 10, which is an intermediate transfer member.

The image forming operation in each image forming station will be described. In the first station (a), the photosensitive drum 1*a* is uniformly charged to a predetermined polarity and potential by a charging roller 2*a* during the rotation step, and then receives an image exposed by an exposure unit 3*a*. Thereby an electrostatic latent image corresponding to a yellow color component image, which is target color image, is formed. Then this electrostatic latent image is developed by a first developing device (yellow developing device) 4*a* at a development position, and visualized as a yellow toner image. The yellow toner image formed on the photosensitive drum 1*a* is transferred to the intermediate transfer belt 10 during the step of passing through a contact (hereafter called "primary transfer nip" or "primary transfer portion") between the photosensitive drum 1*a* and the intermediate transfer belt 10 (primary transfer). The primary untransferred toner remaining on the surface of the photosensitive drum 1*a* is cleaned and removed by a cleaning device 5*a* having a cleaning blade (cleaning member), and is supplied again to the image forming process after charging.

Just like the first station (a), the other stations have a charging roller (2*b*, 2*c*, 2*d*), an exposure unit (3*b*, 3*c*, 3*d*), a developing device (4*b*, 4*c*, 4*d*) and a cleaning device (5*b*, 5*c*, 5*d*) respectively. Therefore, like the first color (yellow) toner image, the second color (magenta) toner image, the third color (cyan) toner image and the fourth color (black) toner image are formed by the respective stations, and sequentially superimposed and transferred onto the intermediate transfer belt 10. Thereby a composite color image corresponding to the target color image is acquired.

The four-color toner image on the intermediate transfer belt 10 is batch-transferred onto the surface of a recording material P, which is fed by a paper feeding unit 50 (secondary transfer) by a secondary transfer nip (secondary transfer portion), which is a contact between the intermediate transfer belt 10 and a secondary transfer roller (current supply member) 20. In the secondary transfer, secondary transfer voltage is applied from a secondary transfer high voltage power supply 21 to the secondary transfer portion via the secondary transfer roller 20, and the secondary transfer current flows accordingly. Then the recording material P bearing the four-color toner images is guided to a fixing unit 30, is heated and pressed there, whereby the four colors of the toner are fused, mixed and fixed to the recording material P. By the above operation, a full-color print image is formed.

The secondary untransferred toner that remains on the surface of the intermediate transfer belt 10 after the secondary transfer is evenly scattered by a conductive brush 16, which is a charging member of the secondary untransferred toner and charged. Then the untransferred toner is charged by the conductive roller 17, and is reversely transferred to the photosensitive drum 1 (1*a*, 1*b*, 1*c*, 1*d*) when the next primary transfer is performed. At this time, the secondary untransferred toner adhering to the photosensitive drum 1 (1*a*, 1*b*, 1*c*, 1*d*) is collected by the cleaning device 5 (5*a*, 5*b*, 5*c*, 5*d*) disposed on the photosensitive drum 1 (1*a*, 1*b*, 1*c*, 1*d*), together with the primary untransferred toner. The cleaning device 5 (5*a*, 5*b*, 5*c*, 5*d*) has a waste toner container (collection unit) for storing the collected toner.

(Configuration and Control of Primary Transfer Portion)

The intermediate transfer belt 10, which is the intermediate transfer member, is disposed at a position facing each image forming station a to d. The intermediate transfer belt 10 is an endless belt which has conductivity generated by adding a conductive agent to a resin material, and is stretched by three shafts of a driving roller 11, a tension roller 12 and a secondary transfer counter roller 13, which constitute the support member, and tensile strength is generated by the tension roller 12. The intermediate transfer belt 10 is rotary-driven in the same moving direction as the counter unit (primary transfer portion) in contact with the photosensitive drums 1*a*, 1*b*, 1*c* and 1*d* at approximately the same peripheral speed as the photosensitive drums 1*a*, 1*b*, 1*c* and 1*d*. In other words, the rotation directions of the intermediate transfer belt 10 and those of the photosensitive drums 1*a*, 1*b*, 1*c* and 1*d* are opposite from each other.

The image forming apparatus charges the intermediate transfer belt 10 by supplying current in the circumferential direction of the intermediate transfer belt 10 using the secondary transfer high voltage power supply 21, a conductive brush high voltage power supply 60 and a conductive roller high voltage power supply 70. In this example, the configuration related to supplying current to the intermediate transfer belt corresponds to the "current supply unit" of the present invention. The primary transfer current flows to the primary transfer portion by the movement of the negative polarity toner on the photosensitive drum 1 onto the intermediate transfer belt 10, because of the potential difference between the intermediate transfer belt 10 and the photosensitive drum 1 (1*a*, 1*b*, 1*c*, 1*d*). Here the current from the secondary transfer roller 20, the current from the conductive brush 16 and the current from the conductive roller 17 are superimposed and flow in the circumferential direction of the intermediate transfer belt 10.

The driving roller 11, the tension roller 12 and the secondary transfer counter roller 13, which stretch the intermediate transfer belt 10, are grounded by two Zener diodes 15*a* and 15*b* which are connected in series in the opposite directions. The Zener voltage values of the Zener diodes 15*a* and 15*b* are both 300V. A Zener diode has a characteristic in which current flows if the Zener voltage is exceeded, so as to maintain the Zener voltage. In other words, the Zener diode is configured such that a part of the current supplied by the secondary transfer roller 20 to the contact portion with the intermediate transfer belt 10 flows to the ground side by the Zener diodes 15*a* and 15*b*, whereby the transfer potential generated in the primary transfer portion does not exceed a predetermined potential. Therefore even if the secondary transfer voltage becomes high, the belt potential can be kept at a constant level, and the primary transfer can be performed stably. As a consequence, by the current flowing from each high voltage power supply 21, 60 and 70 to each stretching roller 11, 12 and 13 via the intermediate transfer belt 10, the potential (±300V) corresponding to the Zener diodes 15*a* and 15*b* is outputted to the intermediate transfer belt 10. Here each stretching roller 11, 12 and 13 is maintained at 300V for both positive and negative polarities, and the back surface potential of the intermediate transfer belt 10 is also maintained at 300V for both positive and negative polarities. For the current flowing to each stretching roller 11, 12 and 13 as well, the current from the secondary transfer roller 20, the current from the conductive brush 16 and the current from the conductive roller 17 are superimposed. Therefore if the superimposed current has positive polarity, the back surface potential of the intermediate transfer belt 10 becomes +300V, and if it has negative polarity, the back surface potential of the intermediate transfer belt 10 becomes −300V.

Here one Zener diode is connected in the reverse direction, in order to supply stable potential to the primary transfer nip, even when voltage with negative polarity is applied in the later mentioned toner ejection processing or the like.

(Toner Ejection Processing)

Now cleaning blade turn-up prevention control for the cartridge will be described as an example of the image forming apparatus adjustment processing (a step that is different from the step of transferring a toner image to a recording material) described in "Description of the Related Art". As described above, in the image forming apparatus that includes a cleaning blade for cleaning toner on the image bearing member in the cartridge, toner ejection processing to supply toner to the cleaning blade nip may be performed. This is to prevent the state where toner on the cleaning blade nip runs out, and the friction force of the blade becomes excessive, which causes faulty cleaning and eventually a blade turn-up.

If the execution conditions of the toner ejection processing are satisfied, this image forming apparatus forcibly uses the exposure units 3*a* to 3*d* to expose the photosensitive drums 1*a* to 1*d* which are uniformly charged to a predetermined potential with the predetermined polarity (negative polarity in this example) by the charging rollers 2*a* to 2*d*. This exposure is performed during a predetermined period so that toner images having an amount of toner required for the toner ejection processing are formed. Thereby electrostatic latent images for toner ejection, which have a predetermined width, are formed on the photosensitive drums 1*a* to 1*d*. Then these electrostatic latent images are developed by the developing devices 4*a* to 4*d* at the development position, and are visualized as toner images. Here the charging polarity of the toner stored in the developing device is normally negative. The toner of the toner images for toner ejection, which are formed on the photosensitive drums 1*a* to 1*d*, is supplied to the cleaning blade, hence the toner images must remain on the photosensitive drums 1*a* to 1*d* without being transferred to the intermediate transfer belt 10. Therefore, the primary transfer polarity is set to be the same as the normal charging polarity of toner, which is negative polarity (reversed polarity of polarity in primary transfer), and held in this state for a predetermined period so that all of the toner images for toner ejection remain on the photosensitive drums 1*a* to 1*d*. Thereby the toner images for toner ejection that passed through the primary transfer nip are supplied to the cleaning blade, and provide a lubrication effect as this toner is collected. In this example, whether the toner ejection processing is executed or not is determined using a page counter for toner ejection. If the page counter for toner ejection reaches a predetermined threshold (X pages in this example), the image forming apparatus executes the toner ejection processing after the image of the Xth page is formed.

In the configuration of the image forming apparatus of this example, when the toner ejection processing is executed, the potential polarity in the secondary transfer portion must be set to negative polarity, since the potential polarity in the primary transfer portion is set to negative polarity for the toner ejection processing.

(System Configuration of Image Forming Apparatus)

Figure 2:
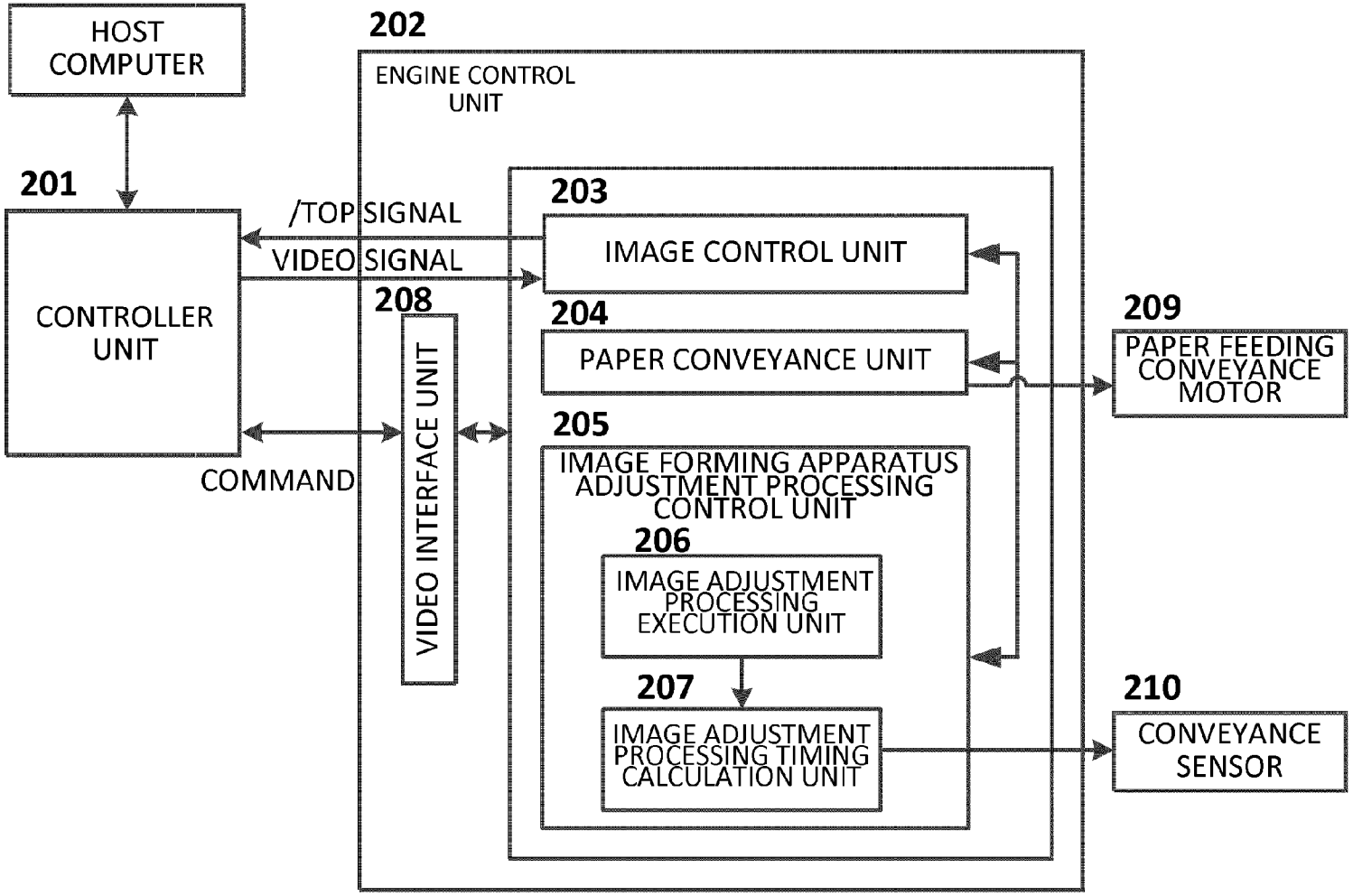
FIG. 2 is a system block diagram of the image forming apparatus according to Example 1 of the present invention.

FIG. 2 is a block diagram depicting the entire system configuration of the image forming apparatus according to this example. A controller unit 201 can be interconnected with a host computer 200 and an engine control unit 202. The controller unit 201 receives image information and print instructions from the host computer 200, analyzes the receiving image information, and converts it into bit data. Then the controller unit 201 transmits a print reservation command, a print start command and a video signal to the engine control unit 202 for each recording material via a video interface unit 208. The engine control unit 202 prepares for print (image formation) execution in the sequence of the print reservation command sent from the controller unit 201, and waits to receive the print start command from the controller unit 201. When the print start command is received, the engine control unit 202 instructs each control unit (image control unit 203, paper conveyance unit 204, adjustment processing control unit 205) to start the print operation according to the information of the print reservation command.

When the print operation start instruction is received from the engine control unit 202, the image control unit 203 starts to prepare for image formation. When image formation is ready to start, the image control unit 203 outputs a /TOP signal, which becomes a reference timing to output a video signal to the controller unit 201. When the /TOP signal is received, the controller unit 201 outputs a video signal based on the /TOP signal. The image control unit 203 forms an image based on the image formation data when the video signal is received from the controller unit 201. The paper conveyance unit 204 starts the paper feeding operation when the print operation start instruction is received. The paper conveyance unit 204 rotates a paper feeding conveyance motor 209 via a paper feeding conveyance motor driver IC (not illustrated), and conveys the paper (recording material) to the secondary transfer position.

For each image formation, the adjustment processing control unit 205 updates the information required for the image forming apparatus adjustment processing, and executes the image forming apparatus adjustment processing when the information satisfies the image forming apparatus adjustment processing conditions. The adjustment processing control unit 205 is constituted by an execution unit 206 and a timing calculation unit 207. The timing calculation unit 207 detects the position of the paper using a conveyance sensor (recording material presence/absence detection unit) 210, and determines the execution timing to execute the image forming apparatus adjustment processing by the execution unit 206 based on the detection result. After the execution timing is determined by the timing calculation unit 207, the execution unit 206 switches the potential polarity of the secondary transfer portion, and executes the above described toner ejection processing, for example. If the adjustment processing is executed during continuous printing, the execution unit 206 pauses the image formation by the image control unit 203 and the paper conveyance by the paper conveyance unit 204.

The above mentioned toner ejection processing is executed at a timing when the rear ends of the toner image on the intermediate transfer belt and the paper on the conveyance path pass through the secondary transfer portion, and cannot be executed until the rear ends of the toner image and the paper pass through the secondary transfer portion, because the polarity of the secondary transfer portion is switched in the toner ejection processing. In this example, a conveyance sensor, which is disposed upstream of the secondary transfer portion, is used for determining the timing when the toner image and the paper pass through the secondary transfer portion respectively. The control performed when the adjustment processing control unit 205 executes the adjustment processing will now be described in detail.

Figure 3A:
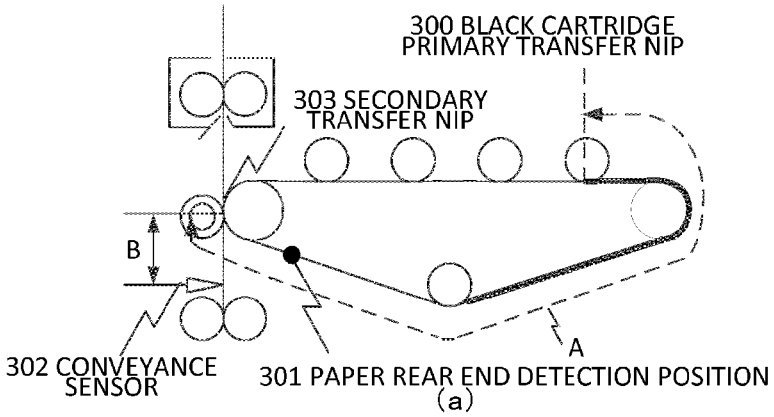
FIGS. 3A, 3B, 3C and 3D are diagrams depicting the relationship between the position of the toner image and the position of the paper at each timing shown in FIG. 4.

FIGS. 3A, 3B, 3C and 3D are diagrams depicting the relationship between the position of the toner image and the position of the paper at each timing. FIG. 4 is a chart depicting a timing to apply the negative polarity to the secondary transfer portion when the toner ejection processing is executed. (a), (b), (c) and (d) in FIG. 4 correspond to the timings (a), (b), (c) and (d) shown in FIGS. 3A, 3B, 3C and 3D respectively.

The toner ejection processing is executed in each station, hence the quickest execution timing is a timing immediately after the primary transfer ends in the black cartridge. In this example, the toner ejection processing execution conditions are checked at the primary transfer end timing (315) in the black cartridge, thereafter the timing to switch the polarity of the secondary transfer portion is controlled.

FIGS. 3A, 3B, 3C and 3D show a case when the relationship of the length of the toner image formed by the image control unit 203 in the conveyance direction (hereafter called "image length") and the length of the paper in the conveyance direction (hereafter called "paper length") is image length<paper length. In concrete terms, FIGS. 3A, 3B, 3C and 3D show a case when the timing at which the rear end of the toner image passes through the secondary transfer portion is before the timing at which the rear end of the paper passes through the secondary transfer portion. Further, in the configuration of this apparatus, the distance from the primary transfer nip (300) to the secondary transfer nip (303) (distance A) in Bk is longer than the distance from the OFF position of the conveyance sensor (302) to the secondary transfer nip (303) (distance B) (Distance A≥Distance B) as illustrated in FIGS. 3A, 3B, 3C and 3D.

When the preparation for image formation completes, the image control unit 203 outputs the /TOP signal (304) and forms the toner images of Y, M, C and Bk based on the video signals received from the controller unit 201 (305 to 308). At this point, the polarity of the secondary transfer portion is positive polarity since the toner images must be transferred to the intermediate transfer member as the primary transfer (312). When the primary transfer of the Bk toner image, described in FIG. 3A, ends, the adjustment processing control unit 205 determines whether the page counter for toner ejection reached X pages (predetermined threshold), and determines whether execution of toner ejection processing is required or not.

If it is determined that execution of the toner ejection processing is required at the primary transfer end timing (315) of the Bk toner image, the adjustment processing control unit 205 waits (309) until the rear end of the toner image is conveyed from the primary transfer nip (300) of Bk to the paper rear end detection position (301).

Now the paper rear end detection position (301) will be described. It is preferable that the paper rear end detection position (301) is disposed at a position that satisfies the following conditions.

(1) To determine the timing to apply the secondary transfer negative polarity during the toner ejection processing, the paper rear end detection position (301) is disposed between the first transfer nip (300) of Bk and the secondary transfer nip (303), which is the quickest timing to execute the toner ejection processing.

(2) To detect the position of the rear end of the paper with certainty at the timing when the rear end of the toner image passes through the secondary transfer nip, the paper rear end detection position (301) is disposed upstream of the secondary transfer nip (303) by at least the distance B (distance from the conveyance sensor OFF position to the secondary transfer nip).

In this example, because of the distance A≥the distance B, the paper rear end detection position (301) can be disposed downstream of the primary transfer nip (300) of Bk. The distance of the paper rear end detection position 301 from the secondary transfer nip (303) is equivalent to the distance B, and the paper rear end detection position 301 is disposed on the belt. The conveyance sensor (302) is a sensor, such as a photo-interruptor, that determines the presence/absence of an object and a position thereof (if it is present). The conveyance sensor (302) is disposed on the conveyance path, and detects ON if paper is on the conveyance sensor (302), and detects OFF if paper is not present.

Figure 3B:
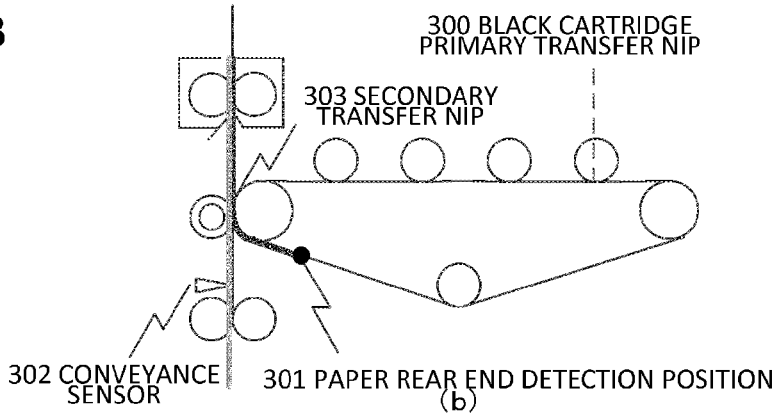
Figure 3C:
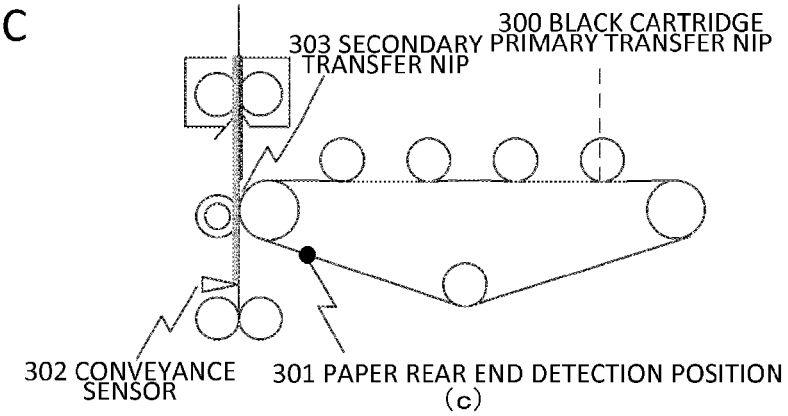
Figure 3D:
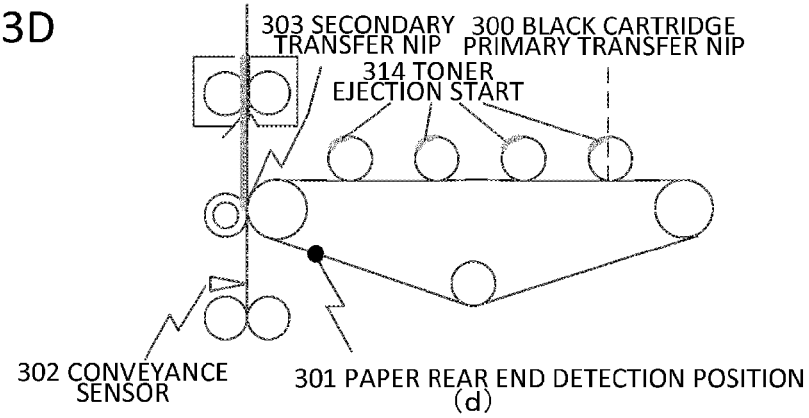
Figure 4:
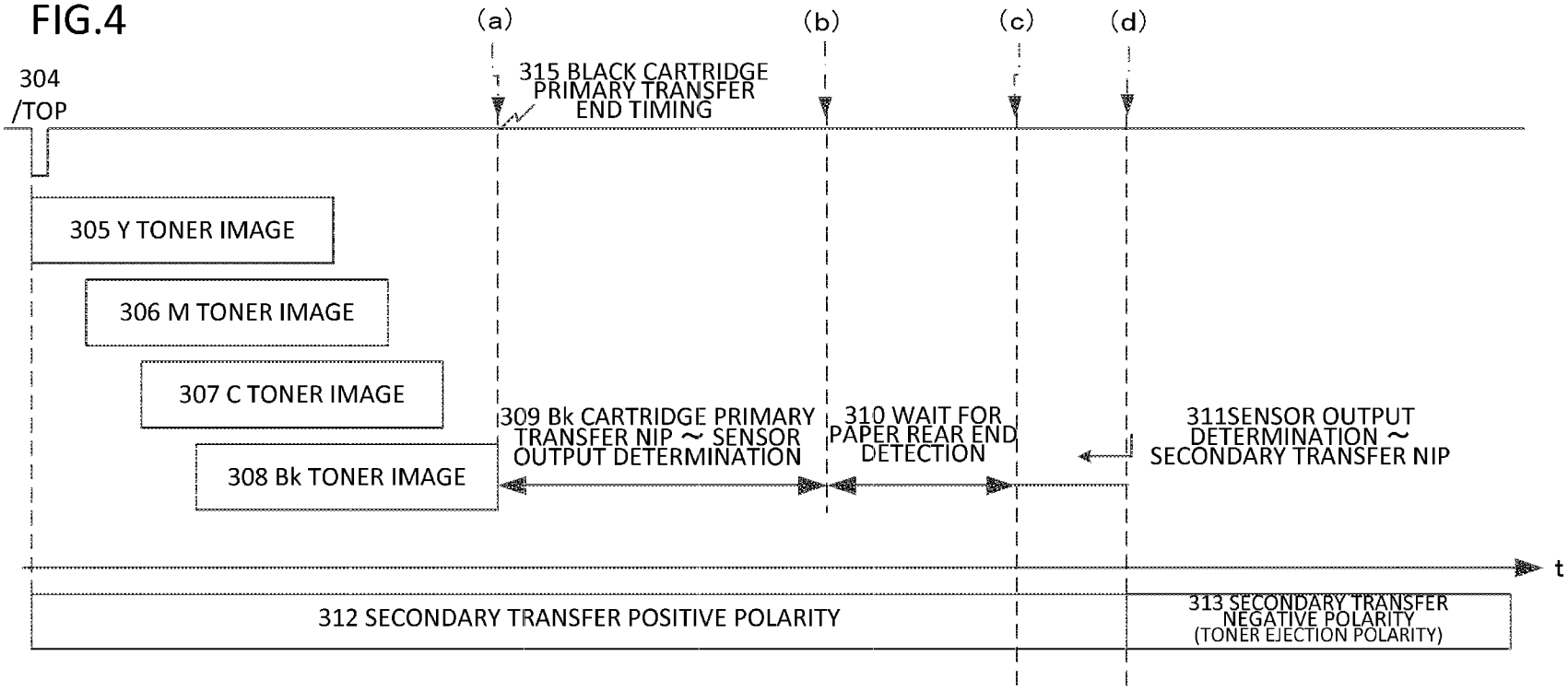
FIG. 4 is a timing chart of the toner ejection control according to Example 1 of the present invention.

The adjustment processing control unit 205 checks the output of the conveyance sensor (302) in the state shown in FIG. 3B, which is a state when the rear end of the toner image reached the paper rear end detection position (301), and detects the presence/absence of paper on the conveyance sensor (302). The paper rear end detection position (301) is disposed at a position of which distance from the secondary transfer nip (303) is equivalent to the distance from the secondary transfer nip (303) to the paper ejection sensor OFF position (distance B). Therefore if the relationship between the image length and the paper length is image length≥paper length, the conveyance sensor (302) outputs "No Paper" at a timing when the rear end of the toner image reaches the paper rear end detection position (301). In other words, if the conveyance sensor (302) detects the absence of paper at the paper rear end detection position (301), the adjustment processing control unit 205 recognizes that the rear end of the paper never passes through the secondary transfer portion after the rear end of the toner image. Therefore in this case, the toner ejection processing can be performed without contaminating the paper, even if the polarity of the secondary transfer portion is switched using the rear end of the toner image as the reference timing of switching.

In the case of image length<paper length, on the other hand, the conveyance sensor (302) outputs that paper exists in the paper rear end detection position (301). In this case, the rear end of the paper passes through the secondary transfer portion after the rear end of the toner image, hence if the polarity of the secondary transfer portion is switched using the rear end of the toner image as the reference timing, the polarity is switched in the state of the paper being held by the secondary transfer nip, and the rear side of the paper may be contaminated. Therefore the adjustment processing control unit 205 waits for the rear end of the paper passing through the secondary transfer nip, and then switches the polarity of the secondary transfer portion to the negative polarity. In other words, using the timing when the conveyance sensor (302) detects the rear end of the paper, (the state in FIG. 3C), as the reference, the adjacent processing control unit 205 waits until the rear end of the paper passes through the secondary transfer nip (303) (311 in FIG. 3D), then switches the polarity of the secondary transfer portion to the negative polarity (313), and executes the toner ejection processing (314).

Figure 5:
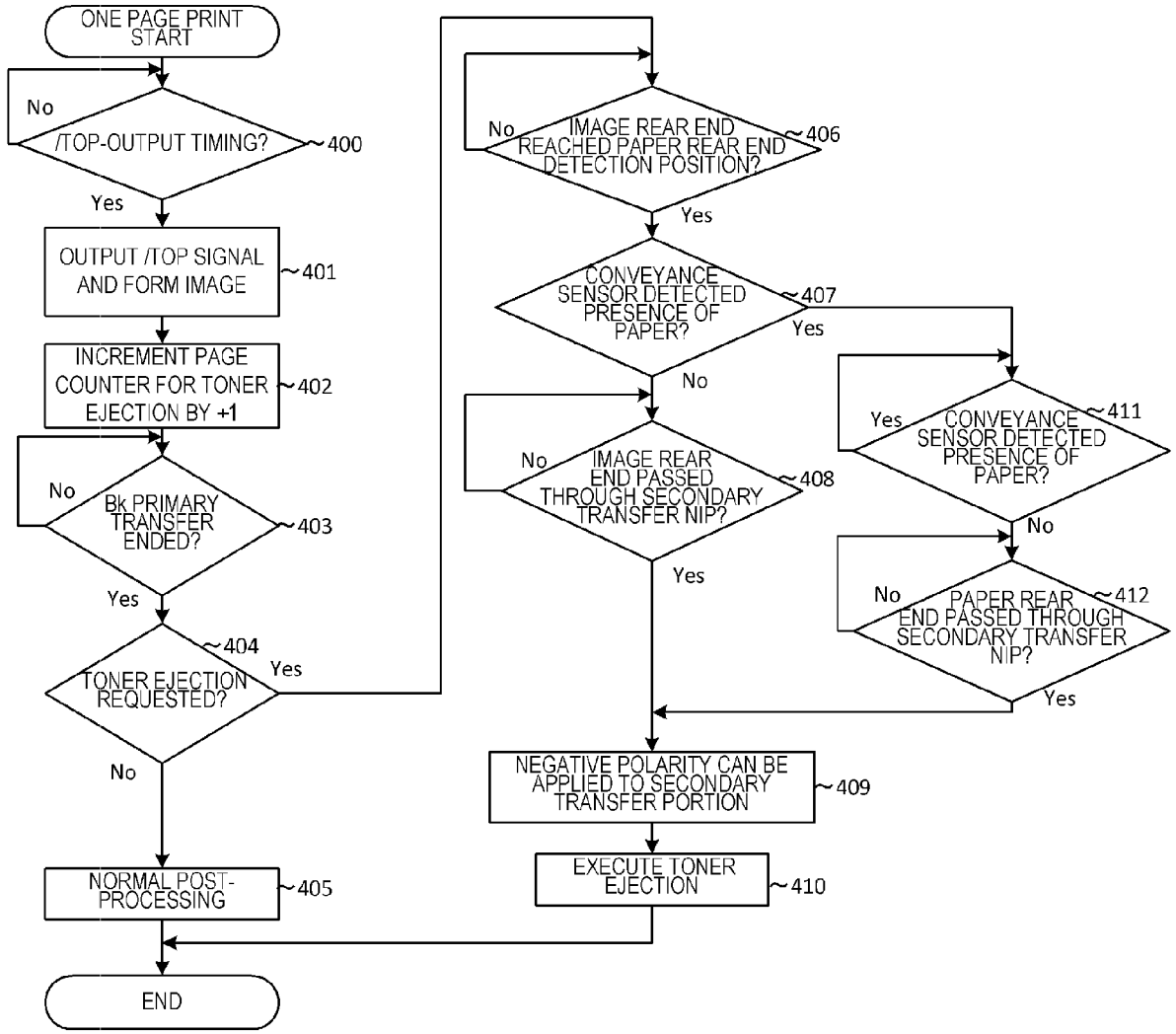
FIG. 5 is a flow chart of the toner ejection control according to Example 1 of the present invention.

FIG. 5 is a flow chart to determine the timing to switch the polarity of the secondary transfer portion for the toner ejection processing, which is a feature of this example. This flow chart describes an example of executing the toner ejection processing after one page of an image is formed.

The engine control unit 202 prepares for forming an image when a print reservation command and a print start command are received from the controller unit 201, and waits for the /TOP output timing (400). When the /TOP output timing is reached, the engine control unit 202 outputs the /TOP signal, and forms an image of each color based on the video signals received from the controller unit 201 (401). The engine control unit 202 also increments the page counter for toner ejection by 1 each time an image is formed (402). Then the engine control unit 202 waits until the primary transfer of Bk ends (403), determines whether the page counter for toner ejection reached X pages (predetermined threshold), and determines whether execution of toner ejection processing is required or not (404).

If it is determined in 404 that the toner ejection processing is not required, the engine control unit 202 executes normal post-processing (405), and ends the image formation.

If it is determined in 404 that the toner ejection processing is required, then the engine control unit 202 detects the timing to switch the polarity of the secondary transfer portion for the toner ejection.

The engine control unit 202 waits until the rear end of the formed image reaches the above mentioned paper rear end detection position (406). When the rear end of the image reaches the paper rear end detection position in 406, the engine control unit 202 detects the presence/absence of the paper using the above mentioned conveyance sensor (407).

If the absence of paper is detected in 407, the adjustment processing control unit 205 waits until the rear end of the image passes through the secondary transfer nip (408), then switches the polarity of the secondary transfer portion from the positive polarity (polarity during image formation) to the negative polarity (409), and executes the toner ejection processing (410).

If the presence of paper is detected in 407, the adjustment processing control unit 205 waits until the conveyance sensor detects the rear end of the paper (411).

Then the processing control unit 205 waits until the rear end of the paper passes through the secondary transfer nip (412), then switches the polarity of the secondary transfer portion to the positive polarity (polarity during image formation) to the negative polarity (409), and executes the toner ejection processing (410).

<Features of this Example>

In this example, when another step that requires switching of polarity of current to be supplied to the intermediate transfer belt (second step) is started without waiting for completion of the image forming step (first step), the switching of polarity is executed after the recording material and the toner image pass through the second transfer unit during the image forming step. In other words, execution of the second step starts in the middle of the fixing step in the immediately preceding image forming step. Therefore when a plurality of different steps is continuously executed, the processing time can be reduced while decreasing the influence on the secondary transfer by the switching of current supplied to the secondary transfer portion.

Passing of the recording material and the toner image through the secondary transfer portion is detected as follows. At a predetermined position (first position) upstream of the secondary transfer portion on the conveyance path of the recording material, a recording material presence/absence detection unit is disposed in order to detect the presence/absence of the recording material at this position. The detection unit detects whether the recording material is present at the first position when the rear end of the toner image is at a predetermined position (second position) upstream of the secondary transfer portion on the conveyance path of the toner image.

The first position and the second position are at equivalent distances from the second transfer unit, which means that if the recording material moves from the first position to the secondary transfer portion and the toner image moves from the second position to the secondary transfer portion respectively at the same timing, the recording material and the toner image simultaneously passes through the secondary transfer portion respectively. In other words, not only when the actual distances are the same, but also when the actual distances are different, the timings of the start from the first position and the second position and the timings of the recording material and the toner image passing through the secondary transfer portion may be controlled to be the same by adjusting the method of conveyance, the conveyance speed or the like.

When the detection result by the detection unit indicates that the recording material is absent when the rear end of the toner image is at the second position, in other words, if the presence of the recording material at the first position was not confirmed, then it is determined that the rear end of the toner image passes through the secondary transfer portion after the rear end of the recording material. In this case, the adjustment processing control unit 205 waits until the rear end of the toner image passes through the second transfer unit, and then switches to supply current to the intermediate transfer belt. The timing of passing of the rear end of the toner image through the secondary transfer portion can be determined from the moving speed of the intermediate transfer belt or the like.

A possible situation where the rear end of the toner image passes through the secondary transfer portion after the rear end of the recording material is, for example, a case when a recording material, of which size is smaller than the correct size of the recording material, was conveyed for some reason (size of the image and that of the recording material are not compatible).

When the detection result by the detection unit indicates that the recording material is present when the rear end of the toner image is at the second position, in other words, if the presence of the recording material at the first position was confirmed, then it is determined that the rear end of the toner image passes through the secondary transfer portion before or at the same time as the rear end of the recording material. In this case, the adjustment processing control unit 205 waits until the rear end of the recording material passes through the secondary transfer portion, and then switches the supply current to the intermediate transfer belt. The timing of the passing of the rear end of the recording material through the secondary transfer portion can be determined from the timing when the detection result by the detection unit switched from the recording material being present to the recording material being absent, and the conveyance speed of the recording material or the like.

The first position, which is the detection position where the presence/absence of the recording material is detected, must be upstream of the secondary transfer portion. In other words, a sufficient distance is required by which the control unit can calculate the time required for the rear ends of the recording material and the toner passing through the secondary transfer portion based on the change of the detection result by the detection unit, and execute the switching of the supply current to the intermediate transfer belt quickly after this time elapses.

As described above, in an image forming apparatus having a configuration which does not allow the primary transfer portion and the secondary transfer portion to independently control the potential polarity, this example makes it possible to switch the supply current to the secondary transfer portion without influencing the secondary transfer in the image forming step. In other words, when the image forming apparatus adjustment processing, to change the polarities of the primary transfer portion and the secondary transfer portion to the polarities that are different from the image forming time respectively, is performed without awaiting the completion of the image forming step, the switching of the current polarity in the secondary transfer portion, when the toner image and the recording material are still in the secondary transfer portion, can be prevented. Thereby contamination of the recording material by ejection of the residual toner, which is generated by the switching of the current polarity of the secondary transfer portion, or contamination of the secondary transfer portion due to the splashing of toner from the toner image passing through the secondary transfer portion, can be prevented.

In this example, the control of the toner ejection was described as an example of the image forming apparatus adjustment processing, but the present invention can also be applied to many other image forming apparatus adjustment processing based on the spirit of the invention, and these applications should not be excluded from the scope of the invention. In this example, the case of performing the toner ejection processing after one image is formed was described, but the present invention can also be applied to the case of performing inter-image adjustment processing during continuous image formation.

Further, in this example, an example of detecting the rear end position of the paper using the output of the conveyance sensor was described, but if the paper length is known in advance, another control flow may be executed. In other words, the timing to pass the secondary transfer portion may be determined based on the result of comparison between the paper length and the image length, and the timing to switch the polarity of the secondary transfer portion may be determined.

In this example, the Zener diode 15 is connected to three shafts of the stretching rollers 11, 12 and 13 respectively, but one or two shafts may be used for connecting the stretching member. Further, conductive members, such as metal rollers, may be disposed at locations facing the photosensitive drums 1*a*, 1*b*, 1*c* and 1*d* respectively in the primary transfer nip of each image forming station, and connected to the Zener diodes 15*a* and 15*b*, just like the case of the stretching rollers 11, 12 and 13. In this example, the Zener diodes 15*a* and 15*b* are used as the voltage stabilizing elements, but other voltage stabilizing elements, such as a varistor, may be used if the same effect can be acquired. The image length described in this example may be received from the controller unit 201 together with the print reservation command, or may be measured by the engine control unit for each image formation.

In this example, it was described that the timing to execute the image forming apparatus adjustment operation is determined using the rear end of the toner image as the reference if image length≥paper length, but in this case, the timing to execute the image forming apparatus adjustment operation may be determined using the rear end of the paper as the reference. Further, in this example, the paper rear end detection position is disposed downstream of the primary transfer nip of the black cartridge to determine execution of the image forming apparatus adjustment processing, but may be disposed upstream thereof.

Example 2

In the configuration of the apparatus in Example 1, the distance from the primary transfer nip (300) of Bk to the secondary transfer nip (303) (distance A, indicated by A in FIG. 3A) is longer than the distance from the OFF position of the conveyance sensor (302) to the secondary transfer nip (303) (distance B, indicated by B in FIG. 3A). Therefore the paper rear end detection position (301) can be disposed at a position at distance B upstream of the secondary transfer nip (303), that is, a position equivalent to the paper ejection sensor (302). Distance B is a distance required for the configuration of the apparatus, or for performing the current switching control of the present invention based on the detection result by the conveyance sensor (302), and the conveyance sensor (302) cannot be disposed downstream of the distance B. Thereby the output of the conveyance sensor (302) can be checked at the paper rear end detection position (301) after the rear end of the toner image reaches the primary transfer end timing (315) of the Bk toner image, and the toner ejection processing execution timing can be determined.

However depending on the apparatus configuration, the distance A may be shorter than the distance B (distance A<distance B). Then the paper rear end detection position (301) cannot be the position at the distance B, which is upstream of the secondary transfer nip (303), and as a consequence the toner ejection processing execution timing in some cases may not be determined by the output of the conveyance sensor (302) alone.

In Example 2, in such a case, not only detecting the rear end of the paper by the conveyance sensor, but the rear end position of the paper is also predicted using the paper length detected by an automatic paper length detection mechanism, or by an actual length detection function which will be described later. Then based on the predicted rear end position of the paper, the timings when the rear end of the toner image on the intermediate transfer belt and the rear end of the paper on the conveyance path pass through the secondary transfer portion are determined, and the toner ejection processing is executed depending on the determined timings.

Figure 6:
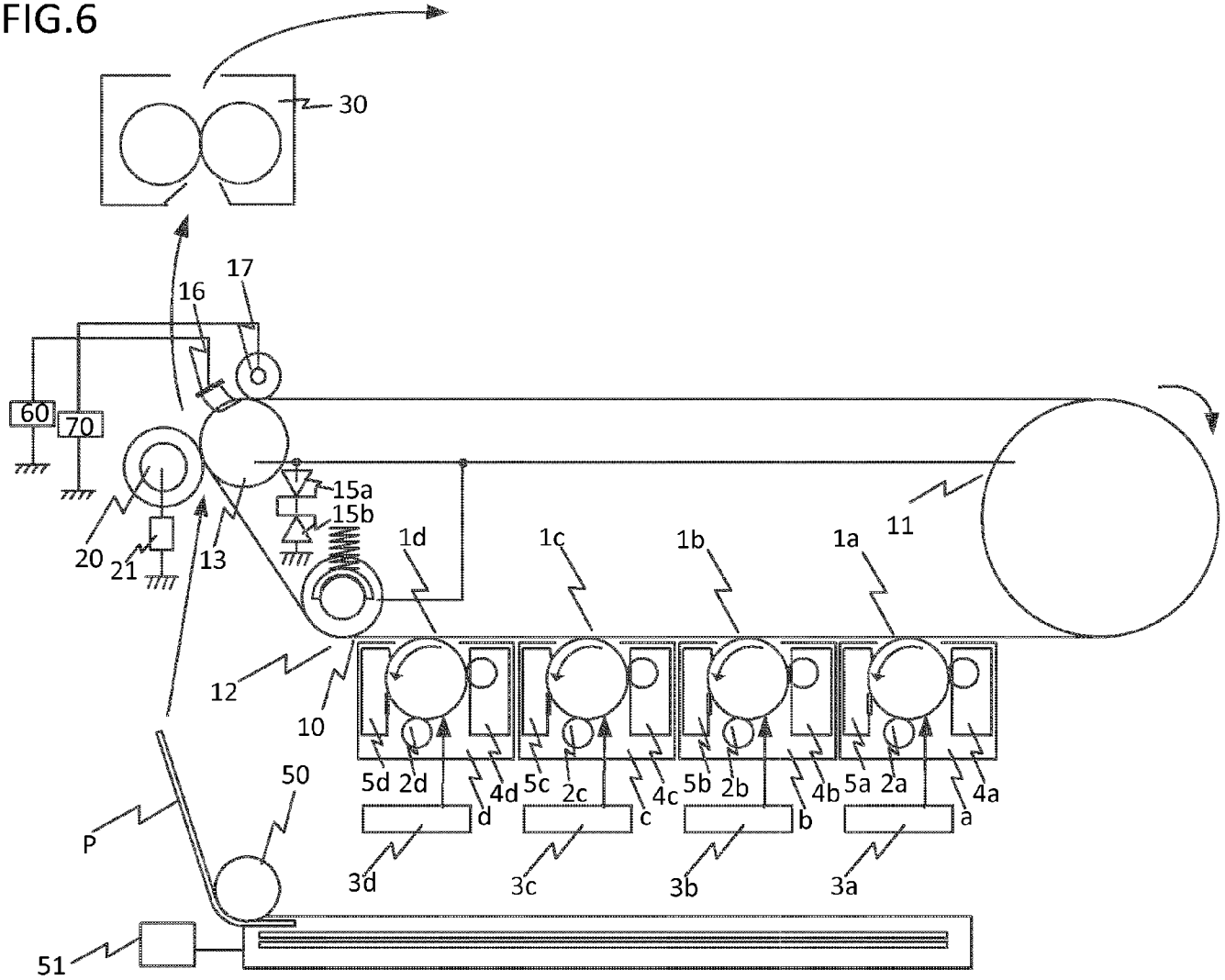
FIG. 6 is a diagram depicting a configuration of an image forming apparatus according to Example 2 of the present invention.

FIG. 6 is a schematic diagram depicting a configuration of an image forming apparatus according to Example 2 of the present invention. The system configuration of Example 2 is the same as Example 1 (system block diagram in FIG. 2), for which description will be omitted. Here primarily the aspects that are different from Example 1 will be described, and description on common aspects with Example 1 will be omitted. In the configuration of the image forming apparatus according to this example, each color station (yellow: a in FIG. 1, magenta: b in FIG. 1, cyan: c in FIG. 1, black: d in FIG. 1) is disposed further downstream in the conveyance direction of the intermediate transfer belt 10, compared with the apparatus configuration of Example 1 (FIG. 1). Each unit and component constituting the apparatus in this example illustrated in FIG. 6 is the same as the configuration of Example 1 illustrated in FIG. 1, and is denoted with a same reference symbol as FIG. 1. According to the configuration in FIG. 6, the toner image formed on the intermediate transfer belt 10 can be more quickly transferred to the secondary transfer portion and transferred to the recording material as the secondary transfer than the configuration in FIG. 1, hence the first print output time (FPOT) can be shortened.

FIGS. 7A to 7C and FIG. 8 are diagrams depicting the toner ejection processing according to this example. In this example, just like Example 1, the toner ejection processing execution conditions are determined at the primary transfer end timing (614, 714, 813) of the black cartridge, and the timing to switch the polarity of the secondary transfer portion is controlled thereafter.

In this example as well, it is preferable that the paper rear end detection position (601, 701, 801) is disposed at a position that satisfies the following conditions as described in Example 1.

(1) To determine the timing to apply the secondary transfer negative polarity during the toner ejection processing, the paper rear end detection position (601, 701, 801) is disposed between the first transfer nip (600, 700, 800) of Bk and the secondary transfer nip (603, 703, 803), which is the quickest timing to execute the toner ejection processing (distance A).

(2) To detect the position of the rear end of the paper with certainty at the timing when the rear end of the toner image passes through the secondary transfer nip, the paper rear end detection position (601, 701, 801) is disposed upstream of the secondary transfer nip (603, 703, 803) by at least the distance B (distance from the conveyance sensor OFF position to the secondary transfer nip).

Figure 7A:
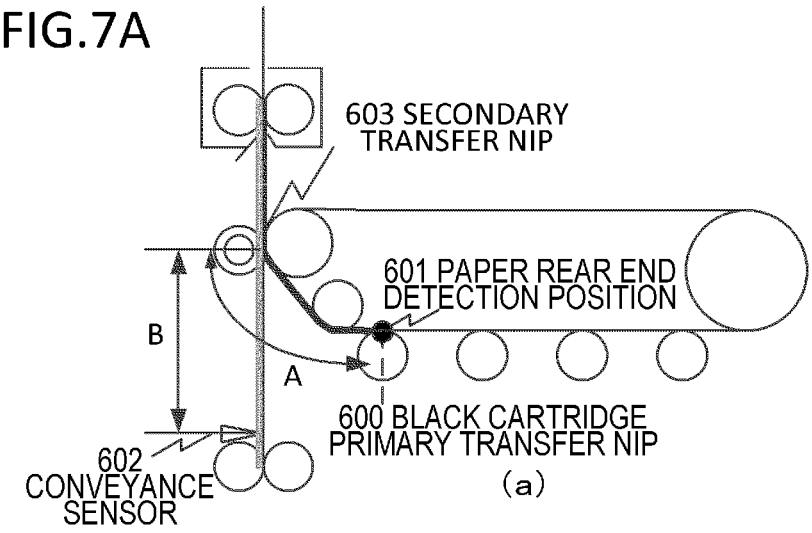
FIGS. 7A, 7B and 7C are diagrams depicting the relationship between the position of the toner image and the position of the paper at each timing shown in FIG. 8.

However in the apparatus configuration of this example, the relationship of the distance A and the distance B is the distance B>the distance A as illustrated in FIG. 7A. Therefore unlike Example 1, the paper rear end detection position cannot be disposed downstream of the primary transfer nip (600, 700, 800) of Bk and at a distance equivalent to the distance from the OFF position of the conveyance sensor (602, 702, 802) to the secondary transfer nip (603, 703, 803) (distance B). This means that the above condition (2) cannot be satisfied. Therefore in this example, the paper rear end detection position (601, 701, 801) is disposed at the same positions as the positions of the primary transfer nip (600, 700, 800) of Bk.

Figure 7B:
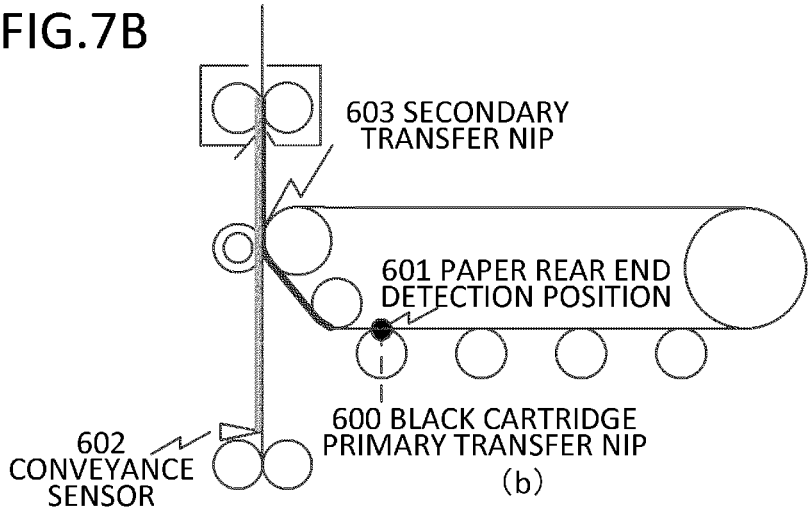
Figure 7C:
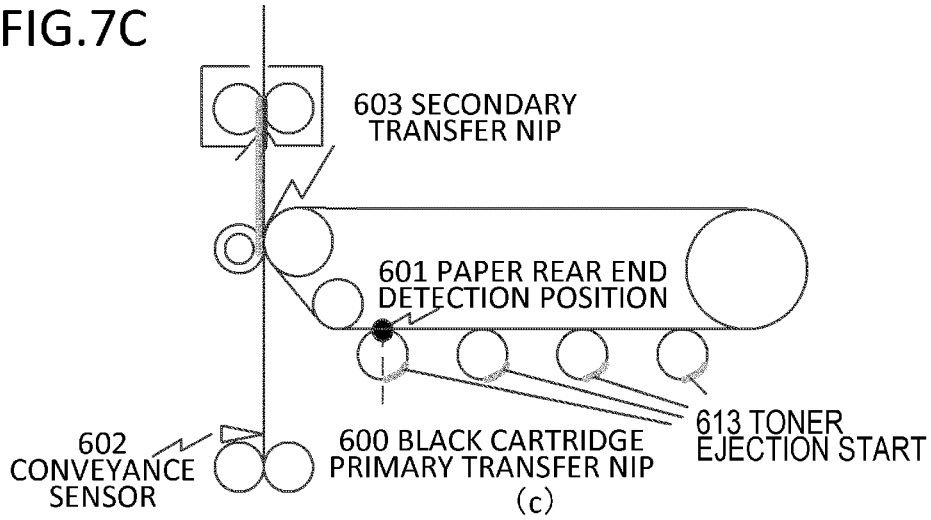
Figure 8:
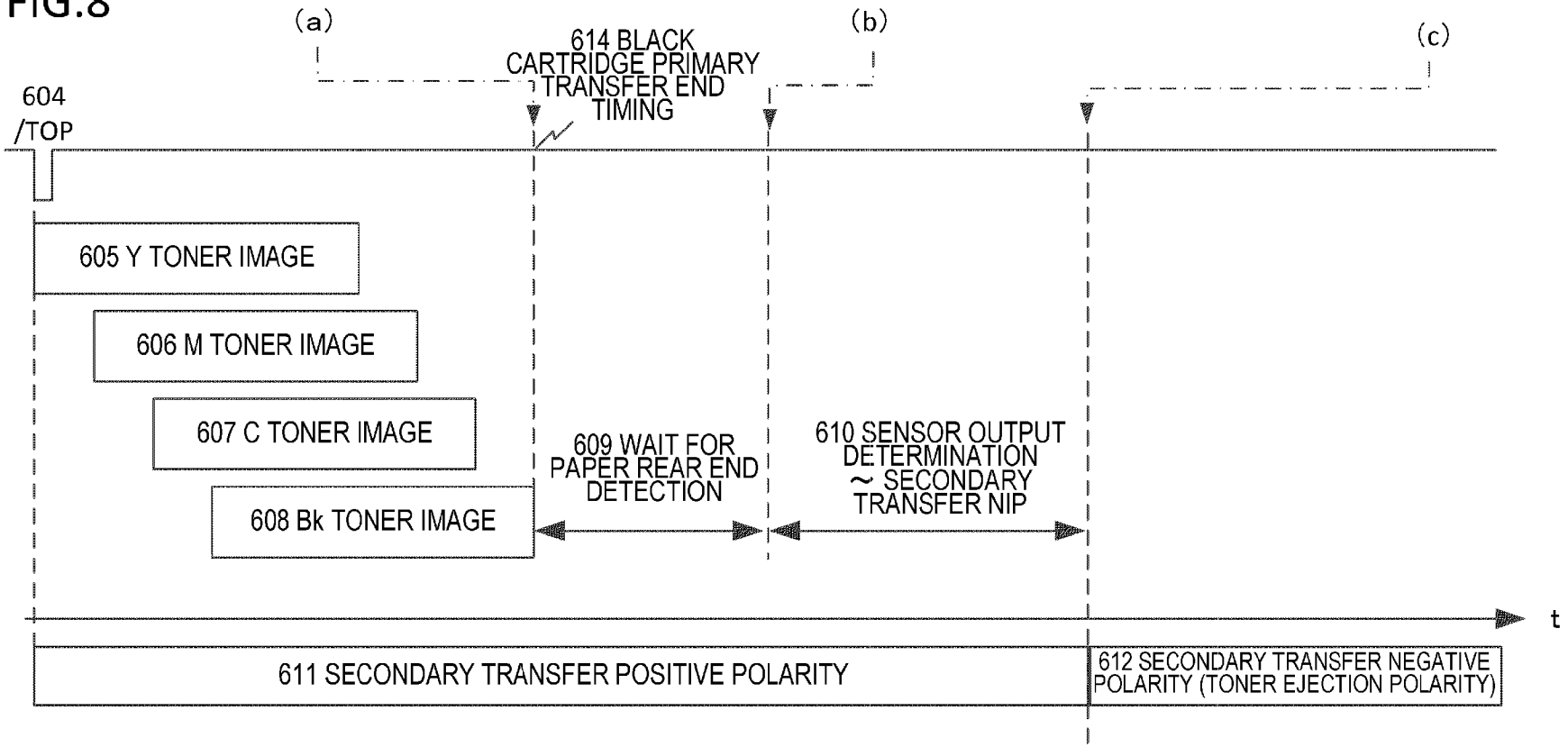
FIG. 8 is a timing chart of the toner ejection control according to Example 2 of the present invention.

FIGS. 7A, 7B and 7C are diagrams depicting the relationship between the position of the toner image and the position of the paper at each timing. FIG. 8 is a chart depicting a timing to apply the negative polarity to the secondary transfer portion when the toner ejection processing is executed. (a), (b) and (c) in FIG. 8 correspond to the timings (a), (b) and (c) in FIGS. 7A, 7B and 7C respectively.

FIGS. 7A to 7C show a state where the output by the conveyor sensor is paper still present when the image control unit 203 reaches the paper rear end detection position. Just like the case of Example 1 (FIGS. 3A to 3D), the image control unit 203 forms toner images of Y, M, C and Bk with setting the polarity of the secondary transfer portion to positive polarity (611) (605 to 608). When the primary transfer of the Bk toner image ends (FIG. 7A), the adjustment processing control unit 205 determines whether the page counter for toner ejection reached X pages as mentioned above, and determines whether execution of the toner ejection processing is required or not. If it is determined that execution of the toner ejection processing is required at the primary transfer end timing (614) of the Bk toner image, the adjustment processing control unit 205 checks the output of the conveyance sensor (602) at the same timing, and detects whether paper is present/absent on the conveyance sensor (602). This becomes the paper rear end detection position (601).

By the result of detecting the paper rear end detection position (601), the adjustment processing control unit 205 recognizes that the rear end of the paper passes through the secondary transfer portion after the rear end of the toner image. In other words, in this example, the paper rear end detection position (601) is located downstream and closer to the secondary transfer nip (603) than to the conveyance sensor (602). Therefore if the conveyor sensor (602), which is located upstream of the paper rear end detection position (601), detects that paper is present when the rear end of the paper is detected at the paper rear end detection position (601), it is recognized that the rear end of the paper is located upstream of the rear end of the toner image.

This means that if the polarity of the secondary transfer portion is switched using the rear end of the toner image as the reference, the polarity is switched in the state where the paper is held by the secondary transfer nip, and the back of the paper may be blemished. Therefore the adjustment processing control unit 205 waits until the conveyance sensor (602) detects the rear end of the paper (detection results changes from paper being present or paper being absent) in order to switch the polarity of the secondary transfer portion to negative polarity after the rear end of the paper passes through the secondary transfer nip (609). When the conveyance sensor (602) detects the rear end of the paper (FIG. 7B), the adjustment processing control unit 205 waits until the rear end of the paper passes through the secondary transfer nip (603), (FIG. 7C, 610), and then switches the polarity of the secondary transfer portion to the negative polarity (612), and executes the toner ejection processing (613).

Figure 9A:
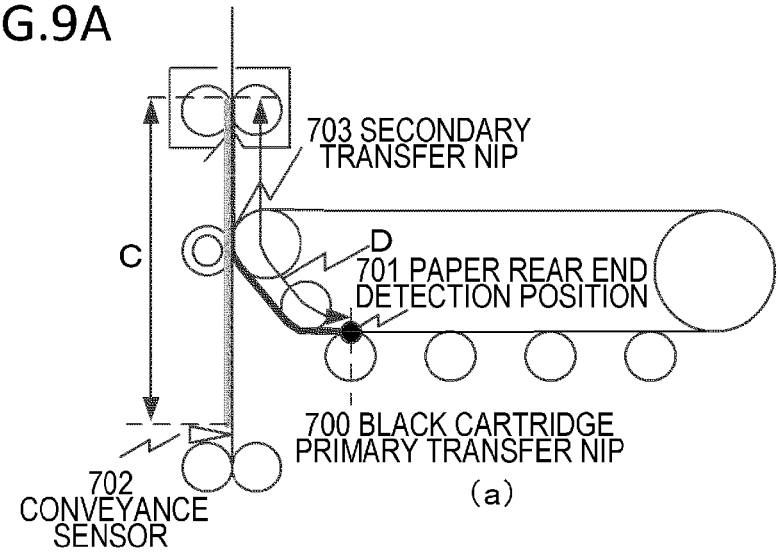
FIGS. 9A, 9B and 9C are diagrams depicting the relationship between the position of the toner image and the position of the paper at each timing shown in FIG. 10.
Figure 9B:
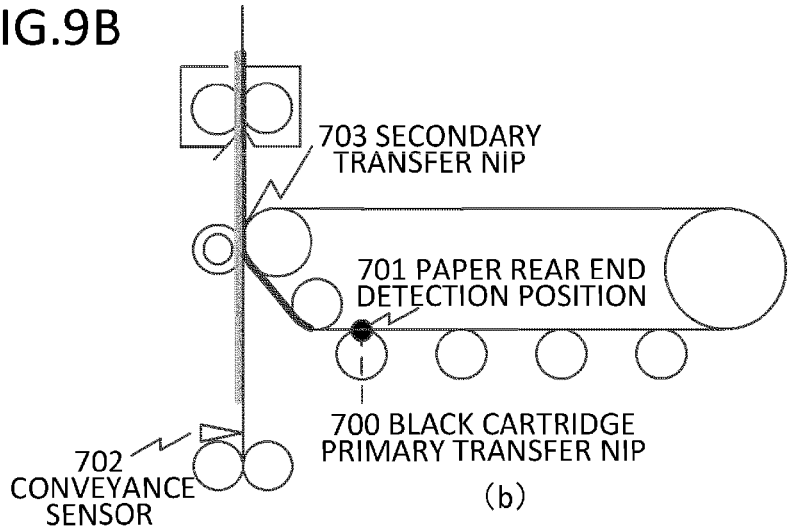
Figure 9C:
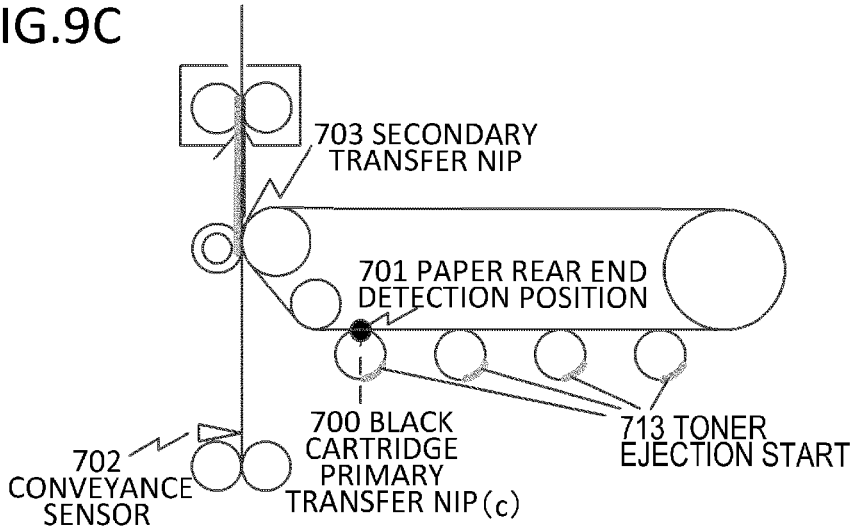
Figure 10:
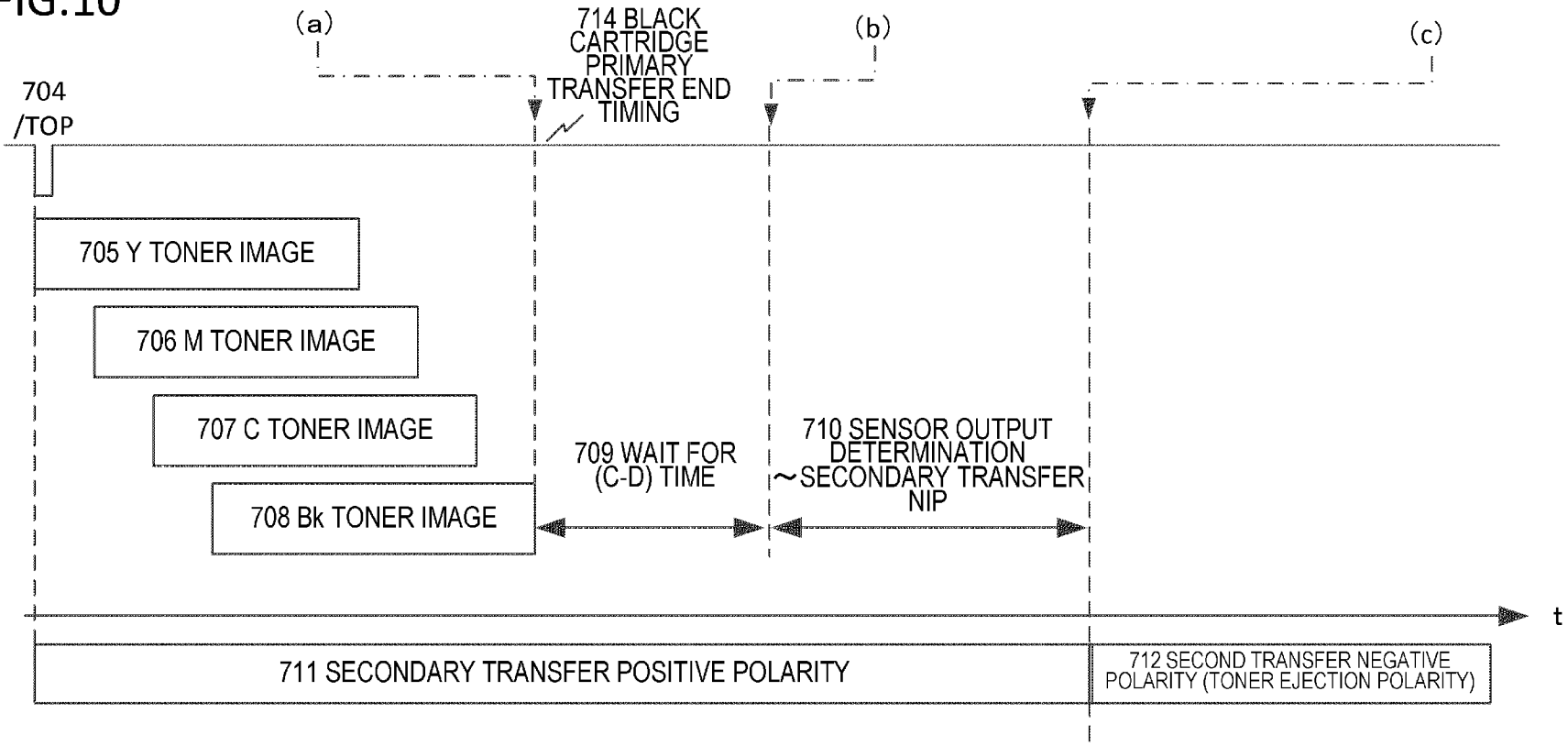
FIG. 10 is a timing chart of the toner ejection control according to Example 2 of the present invention.

FIGS. 9A, 9B and 9C are diagrams depicting the relationship between the position of the toner image and the position of the paper at each timing. FIG. 10 is a chart depicting a timing to apply the negative polarity to the secondary transfer portion when the toner ejection processing is executed. (a), (b) and (c) in FIG. 10 correspond to the timings (a), (b) and (c) in FIGS. 9A, 9B and 9C respectively.

FIGS. 9A to 9C are the case of image length<paper length, and shows a state where the output by the conveyance sensor is that paper being absent when the image control unit 203 reaches the paper rear end detection position. Just like the description of FIGS. 7A to 7C and FIG. 8, the image control unit 203 forms toner images of Y, M, C and Bk (705 to 708), and determines whether execution of the toner ejection processing is required or not when the primary transfer of the Bk toner image ends (FIG. 9A). If it is determined that the execution of the toner ejection processing is required, the adjustment processing control unit 205 checks the output of the conveyance sensor (702) at the same timing, and detects whether paper is present/absent on the conveyance sensor (702). If the output result by the conveyance sensor (702) in the paper rear end detection position (701) is paper being absent, the adjustment processing control unit 205 cannot determine whether the rear end of the paper or the rear end of the toner image passes through the secondary transfer portion first. This is because in the apparatus configuration of this example, the paper rear end detection position (701) and the conveyance sensor (702) are not disposed at a same distance from the secondary transfer portion, so the image length and the paper length cannot be determined by the above output result alone, unlike the case of Example 1. Therefore in this example, the passing timing is determined using the detected paper length based on the assumption that the paper length can be detected in this configuration.

Various methods are known for the paper length detection methods used for the image forming apparatus. A known example to detect the paper length is an automatic paper size detection mechanism that automatically detects the paper size, which is included in the paper feeding unit that stores recording materials. A mechanism having an actual length detect function for detecting the size of paper, that is conveyed using a conveyance sensor installed on the conveyance path, is also known. In Example 2, an automatic paper size detection unit (recording material length detection unit) 51, that automatically detects a paper size, is included in the paper feeding unit, as illustrated in FIG. 6.

Since the conveyance sensor (702) outputs paper being absent at the timing of the paper rear end detection position (701), the adjustment processing control unit 205 compares the image length acquired from the image information or the like and the paper length which is detected in advance. In FIGS. 7A to 7C, if the image length is length D and the paper length is length C, for example, D<C is established. Therefore the polarity of the secondary transfer portion is switched to the negative polarity after the rear end of the paper passes through the secondary transfer nip, which means that the adjustment processing control unit 205 waits at the paper rear end detection position (701) until a time equivalent to (D−C) elapses (709). After the time equivalent to (D−C) elapses (FIG. 9B), the adjustment processing control unit 205 switches the polarity of the secondary transfer portion to the negative polarity (712), and executes the toner ejection processing (713).

Figure 11A:
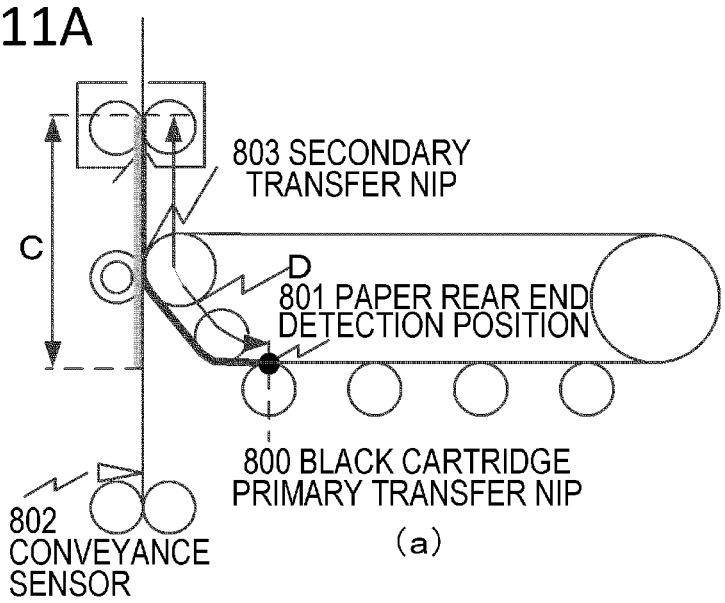
FIGS. 11A and 11B are diagrams depicting the relationship between the position of the toner image and the position of the paper at each timing shown in FIG. 12.
Figure 11B:
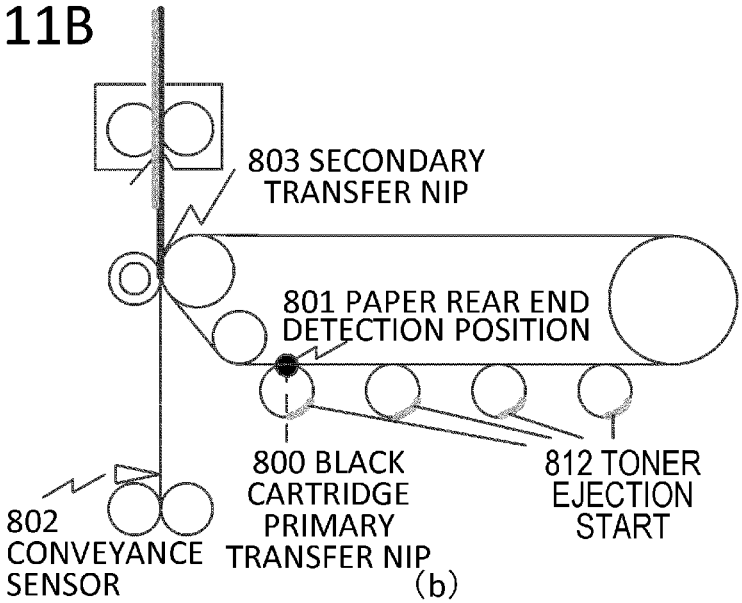
Figure 12:
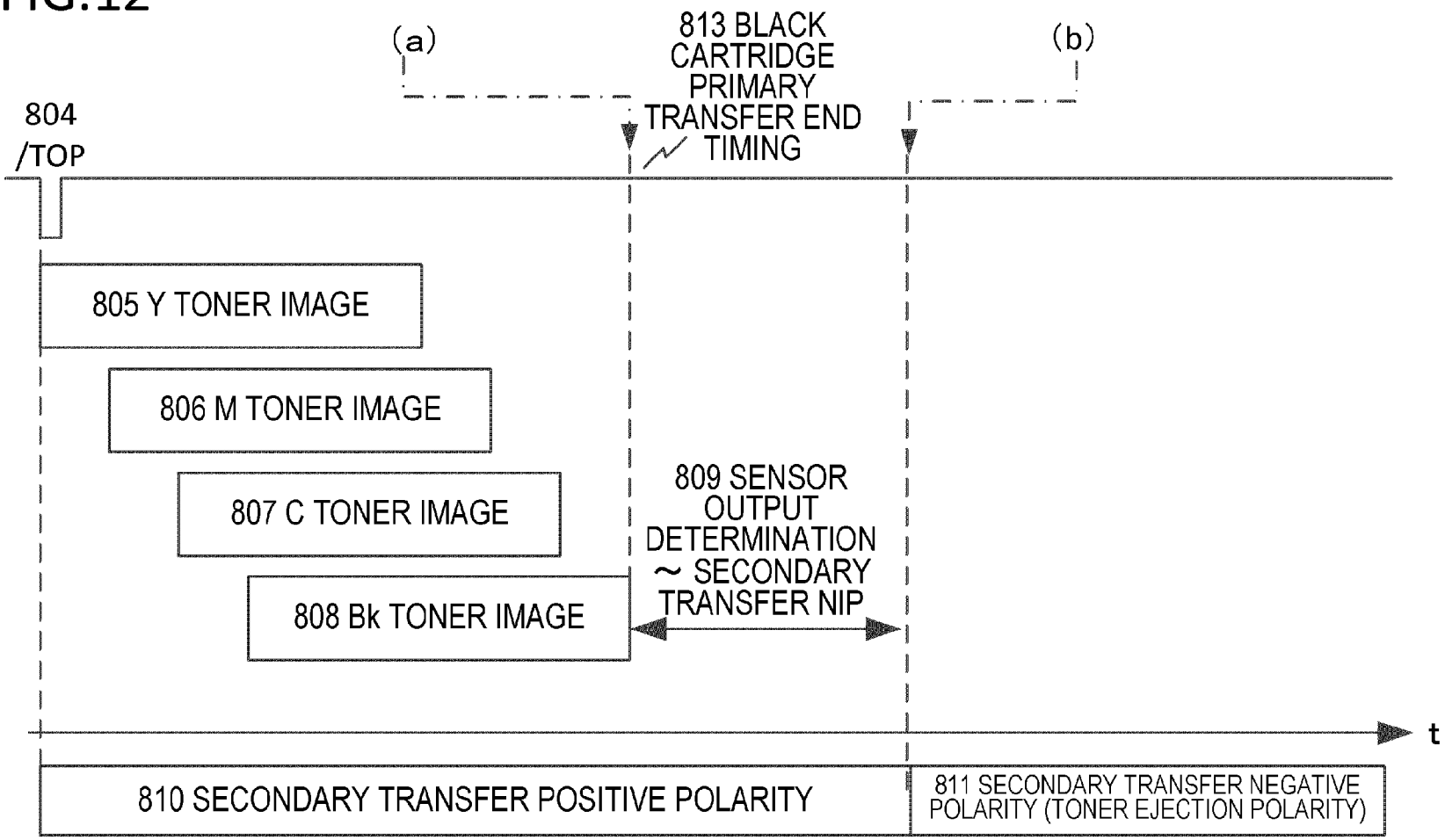
FIG. 12 is a timing chart of the toner ejection control according to Example 2 of the present invention.

FIGS. 11A and 11B are diagrams depicting the relationship between the position of the toner image and the position of the paper at each timing. FIG. 12 is a chart depicting a timing to apply the negative polarity to the secondary transfer portion when the toner ejection processing is executed. (a) and (b) in FIG. 12 correspond to the timings (a) and (b) in FIGS. 11A and 11B respectively.

FIGS. 11A and 11B and FIG. 12 are the case of image length≥paper length (D≥C), which is opposite of the case of FIGS. 9A to 9C and FIG. 10. When the image length and the paper length are compared using the paper rear end detection position (801), it is known that the rear end of the paper passes through the secondary transfer portion at the same time as or before the rear end of the toner image. Therefore the adjustment processing control unit 205 waits until the rear end of the toner image passes through the secondary transfer nip (803) (FIG. 11B), then switches the polarity of the secondary transfer portion to the negative polarity (811), and executes the toner ejection processing (812).

Figure 13:
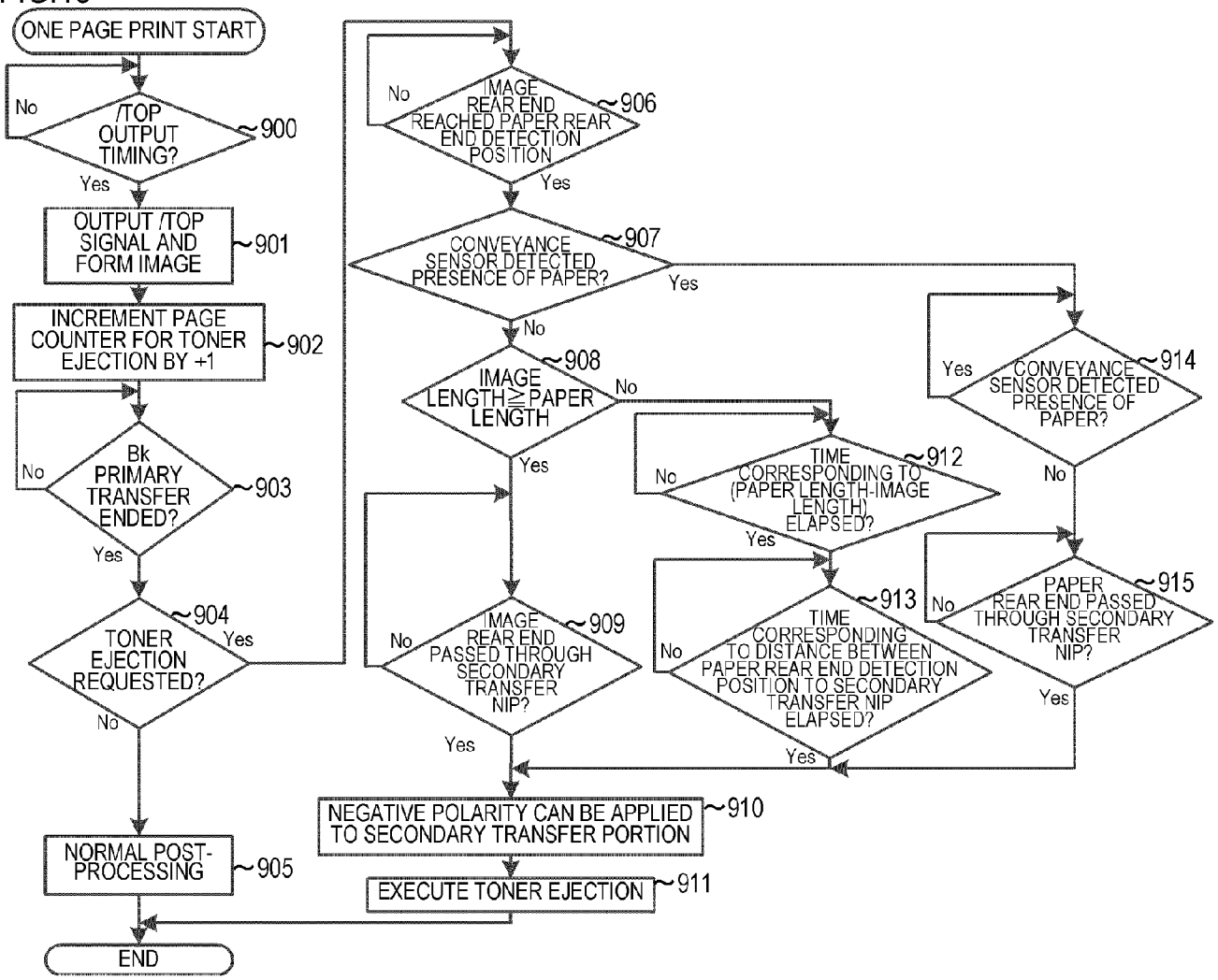
FIG. 13 is a flow chart of the toner ejection control according to Example 2 of the present invention.

FIG. 13 is a flow chart to determine the timing to switch the polarity of the secondary transfer portion for the toner ejection processing, which is a feature of this example. This flow chart is for describing an example of executing the toner ejection processing after one page of an image is formed.

The engine control unit 202 prepares for forming an image when a print reservation command and a print start command are received from the controller unit 201, and waits for the /TOP output timing (900). When the /TOP output timing is reached, the engine control unit 202 outputs the /TOP signal, and forms an image of each color based on the video signal received from the controller unit 201 (901). The engine control unit 202 also increments the page counter for toner ejection by 1 each time an image is formed (902). Then the engine control unit 202 waits until the primary transfer of Bk ends (903), then determines whether the page counter for toner ejection reached X pages (predetermined threshold), and determines whether the execution of toner ejection processing is required or not (904).

If it is determined in 904 that toner ejection process is not required, the engine control unit 202 executes normal post-processing (905), and ends the image formation.

If it is determined in 904 that the toner ejection processing is required, then the engine control unit 202 detects the timing to switch the polarity of the secondary transfer portion for the toner ejection.

The engine control unit 202 waits until the rear end of the formed image reaches the above mentioned paper rear end detection position (906). In this example, this is the same timing as the end of the primary transfer of Bk. When the rear end of the image reaches the paper rear end detection position in 906, the engine control unit 202 detects the presence/absence of the paper using the above mentioned conveyance sensor (907).

If the presence of paper is detected in 907, the adjustment processing control unit 205 waits until the conveyance sensor detects the rear end of the paper (914). Then the adjustment processing control unit 205 waits until the rear end of the paper passes through the secondary transfer nip (915), then switches the polarity of the secondary transfer portion from the positive polarity to the negative polarity (910), and executes the toner ejection processing (911).

If the absence of paper is detected in 907, the adjustment processing control unit 205 compares the image length and the paper length in 908. If it is determined that image length≥paper length, the adjustment processing control unit 205 waits until the rear end of the image passes through the secondary transfer nip (909), then switches the polarity of the secondary transfer portion from the positive polarity to the negative polarity (910), and executes the toner ejection processing (911).

If it is determined that image length<paper length, the engine adjustment processing control unit 205 advances to 913 after time, corresponding to the distance determined by subtracting the image length from the paper length, elapses (912).

Then in 913, the adjustment processing control unit 205 waits until the time corresponding to the distance from the paper rear end detection position to the secondary transfer nip elapses, then switches the polarity of the secondary transfer portion from the positive polarity (polarity during image formation) to the negative polarity (910), and executes the toner ejection processing (911).

<Features of this Example>

The feature of this example is the method to detect the passing of the recording material and the toner image through the secondary transfer portion when the apparatus is configured such that the first position and the second position cannot be disposed at the same distance from the secondary transfer portion, and the second position must be disposed closer to the secondary transfer portion than the first position.

When the rear end of the toner image is at the second position, and if the detection unit detects the recording material being present, that is, if the presence of the recording material at the first position was confirmed, then it can be determined that the rear end of the recording material is more distant from the secondary transfer portion than the rear end of the toner image, and the toner image passes through the secondary transfer portion before the recording material. In this case, the current supplied to the intermediate transfer belt is switched after the rear end of the recording material passes through the secondary transfer portion.

When the rear end of the toner image is at the second position, and if the detection unit detects the recording material being absent, that is, if the presence of the recording material at the first position was not confirmed, then the positional relationship between the rear end of the recording material and the rear end of the toner image cannot be determined by this detection result alone. In this case, the positional relationship is determined using the recording material length detected by a unit to detect the length of the recording material in the conveyance direction (recording material length detection unit).

If the length of the detected recording material is equal to or less than the length of the toner image, this means that the sizes of the image and the recording material are incompatible for some reason, and the toner image extends beyond the recording material, or is formed to the very edge of the recording material. In other words, this is a case when the rear end of the toner image passes through the secondary transfer portion after or at the same time as the rear end of the recording material. In this case, it is determined that the rear end of the recording material never passes through the secondary transfer portion after the rear end of the toner image. Therefore in this case, the current supplied to the intermediate transfer belt is switched after the rear end of the toner image passes through the secondary transfer portion.

If the length of the recording material is longer than the length of the toner image, it is determined that the rear end of the recording material passes through the secondary transfer portion after the rear end of the toner image.

Therefore in this case, the current supplied to the intermediate transfer belt is switched after the elapsed time corresponding to the difference between the length of the recording material and the length of the toner image from the timing when the rear end of the toner image reaches the second position, and the time until the rear end of the recording material at the first position passes through the secondary transfer portion.

As described, according to this example, a technical effect similar to the above mentioned Example 1 can be acquired. For an alternative configuration of the image forming apparatus according to this example, the above mentioned alternative configuration of Example 1 may be used.

According to the present invention, the processing time can be reduced while decreasing the influence on the secondary transfer by the switching of the current supplied to the secondary transfer portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-238169, filed Nov. 25, 2014, which is hereby incorporated by reference herein in its entirety.

What is claimed is:

1. An image forming apparatus, comprising:

an image bearing member that bears a toner image;

an intermediate transfer member onto which the toner image is primarily transferred from the image bearing member in a primary transfer portion that contacts the image bearing member;

a secondary transfer member that constitutes, together with the intermediate transfer member, a secondary transfer portion, and secondarily transfers the toner image from the intermediate transfer member to a recording material in the secondary transfer portion; and a control unit that controls voltage to be applied to the secondary transfer member, wherein the control unit changes polarity of a potential of the intermediate transfer member in the primary transfer portion by changing polarity of the voltage to be applied to the secondary transfer member, applies a first voltage in a first step of forming an image on the recording material by transferring the toner image, and applies a second voltage having polarity opposite to that of the first voltage, in a second step, and in the transition from the first step to the second step, the control unit applies the second voltage to the secondary transfer member after the recording material and the toner image pass through the secondary transfer portion in the first step.

2. An image forming apparatus, comprising:

an image bearing member that bears a toner image;

an intermediate transfer member onto which the toner image is primarily transferred from the image bearing member in a primary transfer portion that contacts the image bearing member;

a secondary transfer member that constitutes, together with the intermediate transfer member, a secondary transfer portion, and secondarily transfers the toner image from the intermediate transfer member to a recording material in the secondary transfer portion;

a detection device that detects the presence/absence of a recording material at a first position which is upstream of the secondary transfer portion on a conveyance path of the recording material; and a control unit, wherein the control unit changes polarity of a potential of the intermediate transfer member in the primary transfer portion by changing polarity of voltage to be applied to the secondary transfer member, and applies a first voltage in a first step of forming an image on the recording material by transferring the toner image, the detection device detects the presence/absence of the recording material at a timing when a rear end of the toner image reaches a second position which is upstream of the secondary transfer portion on a conveyance path of the toner image, and based on the detection result by the detection device, the control unit determines a timing when the voltage to be applied to the secondary transfer member is switched from the first voltage to a second voltage having polarity opposite to that of the first voltage.

3. The image forming apparatus according to claim 2, wherein when the first position and the second position are at a same distance from the secondary transfer portion, and when the detection result by the detection device indicates that the recording material is absent when the rear end of the toner image is at the second position, the control unit waits until the rear end of the toner image passes through the secondary transfer portion, and then applies the second voltage to the secondary transfer member.

4. The image forming apparatus according to claim 2, further comprising a calculation unit that calculates time required for the rear end of the recording material to pass through the secondary transfer portion, wherein when the first position and the second position are at a same distance from the secondary transfer portion, and when the detection result by the detection device indicates that the recording material is present when the rear end of the toner image is at the second position, the control unit waits until the time calculated by the calculation unit elapses after the detection result by the detection device indicates that the recording material is absent, and then applies the second voltage to the secondary transfer member.

5. The image forming apparatus according to claim 2, further comprising a calculation unit that calculates time required for the rear end of the recording material to pass through the secondary transfer portion, wherein when the second position is located downstream of the first position with respect to the secondary transfer portion, and when the detection result by the detection device indicates that the recording material is present when the rear end of the toner image is at the second position, the control unit waits until the time calculated by the calculation unit elapses after the detection result by the detection device indicates that the recording material is absent, and then applies the second voltage to the secondary transfer member.

6. The image forming apparatus according to claim 2, further comprising a recording material length detection unit that detects a length of the recording material in a conveyance direction, wherein when the second position is located downstream of the first position with respect to the secondary transfer portion, and when the detection result by the detection device indicates that the recording material is absent when the rear end of the toner image is at the second position, and the length of the recording material detected by the recording material length detection unit is equal to or less than a length of the toner image in the conveyance direction, the control unit waits until the rear end of the toner image passes through the secondary transfer portion, and then applies the second voltage to the secondary transfer member.

7. The image forming apparatus according to claim 2, further comprising a recording material length detection unit that detects a length of the recording material in a conveyance direction, and a calculation unit that calculates time required for the rear end of the recording material to pass through the secondary transfer portion, wherein when the second position is located downstream of the first position with respect to the secondary transfer portion, and when the detection result by the detection device indicates that the recording material is absent when the rear end of the toner image is at the second position, and the length of the recording material detected by the recording material length detection unit is longer than a length of the toner image in the conveyance direction, the control unit waits until time corresponding to a difference between the length of the recording material and the length of the toner image and the time calculated by the calculation unit to elapse after the timing when the rear end of the toner image reaches the second position, and then applies the second voltage to the secondary transfer member.

8. The image forming apparatus according to claim 2, further comprising a cleaning member that contacts a surface of the image bearing member so as to clean the surface.

9. The image forming apparatus according to claim 8, further comprising a collection unit that collects toner removed from a surface of the image bearing member by a cleaning member.

10. The image forming apparatus according to claim 2, wherein the intermediate transfer member is an endless belt.

11. The image forming apparatus according to claim 10, further comprising:

a support member that supports the belt; and a voltage stabilizing element that is connected to the support member, wherein a part of current supplied by the secondary transfer member to the belt flows to the ground side by the voltage stabilizing element, so that the potential generated in the primary transfer portion, which is constituted by the belt and the image bearing member, does not exceed a predetermined potential.

12. The image forming apparatus according to claim 11, wherein the voltage stabilizing element is a Zener diode.

13. The image forming apparatus according to claim 12, wherein the secondary transfer member contacts the belt at a position where the secondary transfer member faces the support member via the belt.

* * * * *